US007506425B2

(12) United States Patent
Kim

(10) Patent No.: US 7,506,425 B2
(45) Date of Patent: Mar. 24, 2009

(54) METHOD FOR MANUFACTURING A DRUM OF A WASHING MACHINE

(75) Inventor: Geon Kim, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 601 days.

(21) Appl. No.: 11/066,535

(22) Filed: Feb. 28, 2005

(65) Prior Publication Data

US 2005/0252254 A1 Nov. 17, 2005

(30) Foreign Application Priority Data

May 15, 2004 (KR) ..... 10-2004-0034561

(51) Int. Cl.
*B23P 11/00* (2006.01)

(52) U.S. Cl. ..... 29/509; 29/521; 72/368; 72/370.27; 72/379.2; 403/282

(58) Field of Classification Search ..... 29/509, 29/521, 557; 72/365.2, 368, 370.11, 370.27, 72/379.2; 403/282, 285
See application file for complete search history.

(56) References Cited

U.S. PATENT DOCUMENTS 1,472,434 A 10/1923 Oberg
3,879,994 A * 4/1975 Hume ..... 72/127
5,746,070 A 5/1998 Bailey et al.

FOREIGN PATENT DOCUMENTS

| | | | |
|---|---|---|---|
| AT | 244277 B | | 12/1965 |
| DE | 19821366 C1 | | 8/1999 |
| EP | 0395859 A1 | | 11/1990 |
| GB | 853824 | | 11/1960 |
| JP | 2002200399 A | * | 7/2002 |
| KR | 10-2003-0060551 A | | 7/2003 |
| WO | WO-2007/023453 A1 | | 3/2007 |

* cited by examiner

*Primary Examiner*—Jermie E Cozart
(74) *Attorney, Agent, or Firm*—Birch, Stewart, Kolasch & Birch, LLP

(57) ABSTRACT

Provided is a drum of a washing machine and method for manufacturing the same in which the drum can be rigidly manufactured at a low cost. The method includes forming a plurality of holes on a surface of a metal plate, bending first and second end portions of the metal plate, rolling the metal plate into a shape of a hollow cylinder and engaging the first bent end portion with the second bent end portion, and curling the engaged first and second bent edge portions toward an inner surface of the hollow cylinder and seaming the engaged first and second bent end portions to an outer surface of the hollow cylinder.

20 Claims, 9 Drawing Sheets

METHOD FOR MANUFACTURING A DRUM OF A WASHING MACHINE

This application claims the benefit of the Korean Application No. P2004-034561 filed on May 15, 2004, which is hereby incorporated by reference.

BACKGROUND OF THE INVENTION

1. Field of the Invention

The present invention relates to a drum of a washing machine and a method for manufacturing the same, and more particularly, to a drum of a washing machine and a method for manufacturing the same in which the drum is rigidly and easily manufactured.

2. Discussion of the Related Art

Generally, a washing machine is an apparatus to get clothes, bedclothes and the like (hereinafter referred to as 'laundry') clean through washing, rinsing, squeezing and drying cycles such that dirt that has stuck on the laundry received in a drum is removed by a chemical interaction of water and detergent fed to a tub.

FIG. 1 is a sectional view illustrating an inside of a washing machine according to the related art.

Referring to FIG. 1, the related art washing machine includes a cabinet 3 disposed above a base 2, a laundry entrance hole 4 formed at a front side of the cabinet 3, and a cabinet cover 6 to which a door 5 for opening and closing the laundry entrance hole 4 is rotatably connected. A control panel 7 for inputting operation cycles or time of the washing machine is disposed above the cabinet cover 6. A top plate 8 is disposed on an upper surface of the cabinet 3.

A tub 10 accommodating water mixed with detergent or clean water (hereinafter referred to as 'washing water') is shock-absorbably installed above the base 2.

The tub 10 is mounted on a damper 2*a* connected with the base 2 and is hung and connected to a spring 3*a* connected to both sides of the cabinet 3 to be shock-absorbably supported by the damper 2*a* and the springs 3*a*.

The tub 10 is shaped in a horizontal laid cylinder, and includes an opening 11 formed at a rear of the entrance hole 4. A gasket 14 is installed at the opening 11. The gasket 14 is closely in contact with a rear surface of the door 4 when the door 5 is closed, to prevent washing water (w) from being leaked and laundry (m) from escaping.

The tub 10 also includes a water feed hole through which washing water is fed, a water drainage hole through which washing water is drained, and a driving motor 15 formed at a rear surface thereof, for rotating a drum 20 to be described later.

The driving motor 15 includes a stator fixed to the rear surface of the tub 10, a rotator encircling a circumference and rear surface of the stator, and a shaft fixed to the rotator, perforating the rear surface of the tub 10 and fixed to a rear surface of the drum 20.

Like the tub 10, the drum 20 is shaped in a laid cylinder such that a lower side thereof is dipped in washing water (w) in the tub 10. The drum 20 is rotatably disposed inside the tub 10 and has holes 21*a*, 23*a* through which washing water or air passes, and a lifter 21*b* for lifting and then dropping the laundry (m).

Meanwhile, a water feed unit for feeding water mixed with detergent or clean water to the inside of the tub 10 is connected to a water feed hole of the tub 10.

The water feed unit includes a feed valve 30 connected with an extension hose 30*a*, for adjusting water supply through the extension hose 30*a*, a feed hose 32 for guiding water that has passed through the feed valve 30, a detergent box 34 receiving detergent therein such that the detergent is mixed with the water guided by the feed hose 32, and a feed bellows tube 36 for guiding the washing water that has passed through the detergent box 34 to the feed hole of the tub 10.

In addition, a water drainage unit for draining washing water in the tub 10 to an outside of the washing machine is connected to a drainage hole of the tub 10.

The water drainage unit includes a drainage bellows tube 40 connected to the drainage hole of the tub 10 such that the washing water (w) inside the tub 10 is drained, a drainage pump 42 for pumping the washing water guided to the drainage bellows tube 40, and a drainage hose 44 connected to the drainage pump 42, for draining the washing water pumped by the drainage pump 42 to the outside of the washing machine.

Operation of the above washing machine will now be described with reference to the accompanying drawing.

First, as a user opens the door 5, loads laundry (m) into the inside of the drum 20, closes the door 5, and inputs instructions such as washing, rinsing, squeezing and the like, the washing machine operates according to the input instructions.

When the washing cycle is inputted, the feed valve 30 is turned on to feed water. The fed water passes through the detergent box to be mixed with detergent, is received in inner lower side of the tub 10, introduced into the inside of the drum 20 through the holes 21*a*, 23*a* of the drum 20 to soak the laundry.

When a predetermined amount of water is fed to the inside of the tub 10, the washing machine turns off the feed valve 30 and turns on the motor 15 to agitate the drum 20 in the left and right direction.

When the drum 20 is agitated in the left and right direction, the laundry (m) is lifted up by the lifter 21*b* and dropped, so that dirt is removed from the laundry by the chemical interaction between water and detergent.

After an elapse of a predetermined time, the washing machine turns off the motor 15 turns on the drainage pump 42 to drain the used water to the outside of the washing machine. After the drainage of the used water is completed, the washing machine turns off the drainage pump 42.

When the rinsing cycle is inputted, the washing machine turns on and off the feed valve 30, the motor 15 and the drainage valve 42 like in the washing cycle to rinse the laundry.

When the squeezing cycle is inputted, the washing machine operates the motor 15 at a high speed.

As the motor operates at the high speed, the drum 20 rotates too at a high speed. During the rotation of the drum 20, the laundry is closely in contact with an inner surface of the drum 20 to squeeze water from the laundry.

At the time of the high speed operation of the motor 20, the washing machine turns on the drainage pump 42 to drain the used washing water to the outside of the washing machine and turns off the drainage pump 42 when the used washing water is completely drained.

Meanwhile, the washing machine requires less torsion of the drum 20, less damage, and better strength because the drum 20 is agitated in the left and right direction or rotated at the high speed during the washing, rinsing, and squeezing cycles.

The drum 20 may be manufactured as a single plastic injection molding or by coupling a plurality of metal members 21, 22 and 23. Upon considering vibration generated during the rotation of the drum 20 or impact on the tub 10, it is most preferable to manufacture the drum 20 by coupling the metal members 21, 22 and 23.

In other words, it is the trend these days that the drum 20 is configured to include the cylindrical center drum 21, the front drum 22 coupled to a front end of the center drum 21 and having a laundry entrance hole 22*a*, and a back drum 23 covering the rear surface of the center drum 21.

The center drum 21 has the plurality of holes 21*a* and a plurality of lifters 21*b* formed on an inner circumference thereof The laundry entrance hole 22*a* of the front drum 22 is shaped in a circle. The back drum 23 has a plurality of holes 23*a* and a spider 23*b* formed at a rear surface thereof and to which the shaft of the driving motor 15 is connected.

In the related arts, to manufacture the drum 20, the cylindrical center drum is manufactured by rolling a metal plate in a cylindrical form to surface-contact both ends of the rolled metal plate and then welding or bonding the surface-contacting both ends. Then, the cylindrical center drum 21 is coupled with the front drum 22 and the back drum 23 by surface-contacting the cylindrical center drum 21 with the front drum 22 and the back drum 23 and welding the surface-contacting portion.

However, according to the method for manufacturing the drum of the washing machine according to the related art, since the center drum 21 is made in the shape of cylinder by a welding or bonding and the front drum 22 and the back drum 23 are coupled to the center drum by a welding or bonding, the welding portion or the bonding portion may be fractured easily due to a large vibration and more cost is required for the manufacturing of the drum.

SUMMARY OF THE INVENTION

Accordingly, the present invention is directed to a drum of a washing machine and method for manufacturing the same that substantially obviates one or more problems due to limitations and disadvantages of the related art.

An object of the present invention is to provide a drum of a washing machine and method for manufacturing the same in which the drum can be rigidly manufactured at a low cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for manufacturing a drum of a washing machine, the method comprising, forming a plurality of holes on a surface of a metal plate, bending first and second end portions of the metal plate, rolling the metal plate into a shape of a hollow cylinder and engaging the first bent end portion with the second bent end portion, and curling the engaged first and second bent edge portions toward an inner surface of the hollow cylinder and seaming the engaged first and second bent end portions to an outer surface of the hollow cylinder.

Preferably, the forming a plurality of holes comprises piercing a hole through which water and air passes, and piercing a mounting hole into which a lifter for lifting laundry is mounted.

Preferably, the hole piercing a hole further comprises inverse burring for removing a bur formed in piercing a hole.

Preferably, the piercing a hole, the piercing a mounting hole, and the inverse burring are performed by a punching unit.

Preferably, the first and second end portions of the metal plate are bent in opposite directions. Preferably, each of the first and second end portions of the metal plate is bent at an angle of more than 90 degrees. Specifically, each of the first and second end portions of the metal plate is bent in a shape of letter "z".

Preferably, the curling/seaming step comprises flattening protrusions on an inner surface of the hollow cylinder at first and second end portions of the hollow cylinder, the protrusions caused by curling the first and second end portions of the metal plate.

Preferably, the above method may further include first and second bent end portions of a center drum bent toward an outer surface of the hollow cylinder.

Alternatively, the above method may further include a coupling step of coupling a center drum with a front drum and a back drum, the front drum being coupled to the first bent end portion of the center drum and the back drum being coupled to the second bent end portion of the center drum.

Preferably, the coupling step comprises enclosing a circumferential portion of the front drum to the first bent end portion of the center drum, and curling the circumferential portion of the front drum with the first bent end portion of the center drum.

Alternatively, the above method may further include spot-welding the curled circumferential portion of the front drum engaged to the first bent end portion of the center drum to the hollow cylinder.

Preferably, the coupling step comprise enclosing a circumferential portion of the back drum to the second bent end portion of the center drum, and curling the circumferential portion of the back drum with the second bent end portion of the center drum.

Alternatively, the above method may further include spot-welding the curled circumferential portion of the back drum engaged to the second bent end portion of the center drum to the hollow cylinder.

According to another aspect of the present invention, there is provided a drum of a washing machine, comprising a center drum having a hollow cylinder and first and second bent end portions, the hollow cylinder is provided by curling and seaming a metal plate and includes a plurality of holes on a surface area, a front drum having a circumferential portion engaged to the first bent end portion of the center drum by curling the circumferential portion with the first bent end portion of the center drum, and a back drum having a circumferential portion engaged to the second bent end portion of the center drum by curling the circumferential portion with the bent end portion formed of the center drum.

Preferably, the bent end portion of the center drum comprises a curled edge portion having been flattened. Preferably, a surface area of the seamed hollow cylinder has grooves Preferably, the center drum comprises a central protruded portion formed on an inner circumferential surface of the hollow cylinder.

Preferably, the circumferential portion of the front drum which is curled towards an outer surface of the hollow cylinder is spot-welded to the outer surface of the hollow cylinder of the center drum.

Preferably, the circumferential portion of the back drum which is curled towards an outer surface of the hollow cylinder is spot-welded to the outer surface of the hollow cylinder of the center drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

An exemplary embodiment of a washing machine and a washing box provided in the washing machine will now be described with reference to the accompanying drawings.

Figure 1:
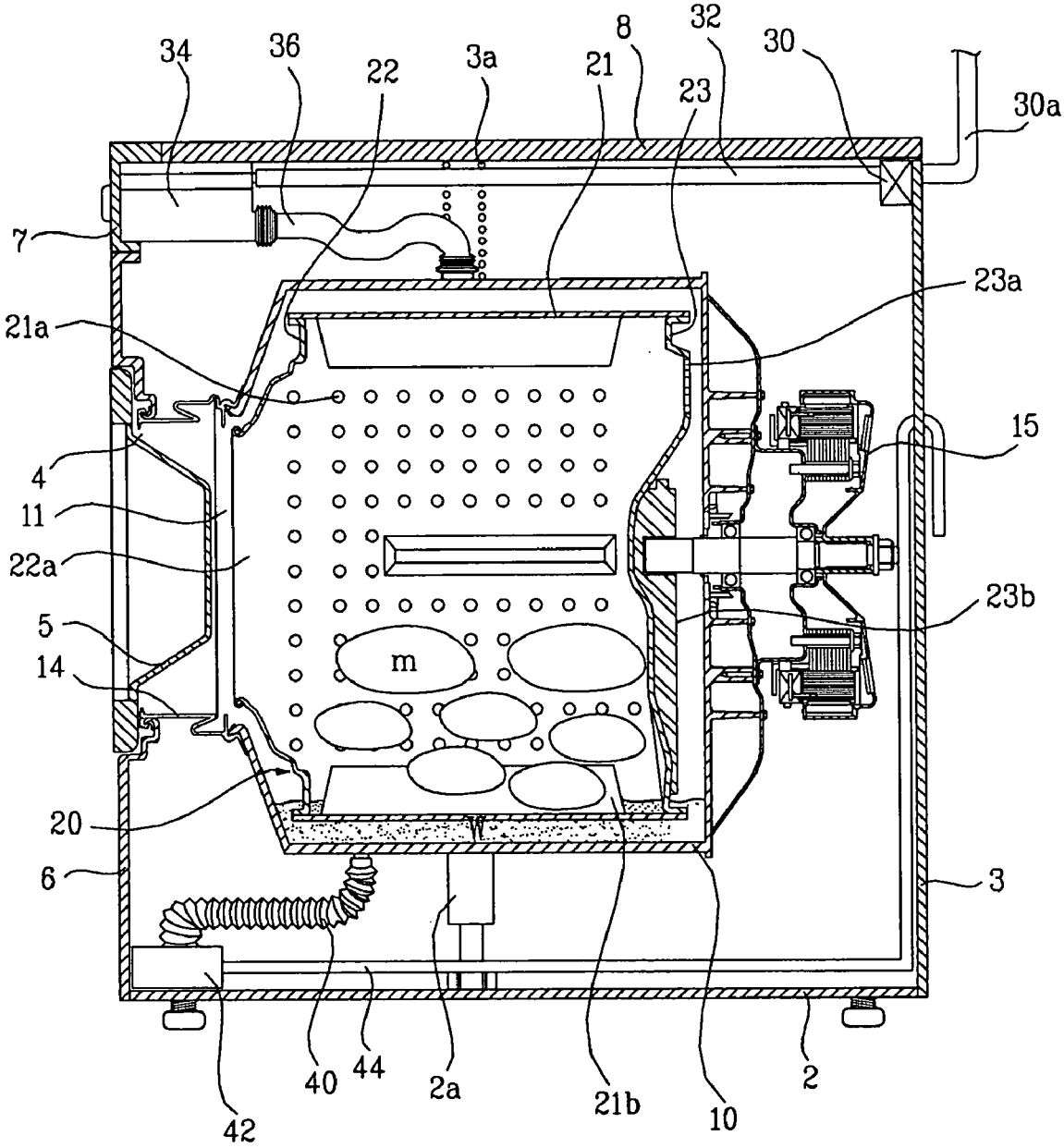
FIG. 1 Prior Art
FIG. 1 is a sectional view of a washing machine according to the related art and shows an inside of the washing machine.
Figure 2:
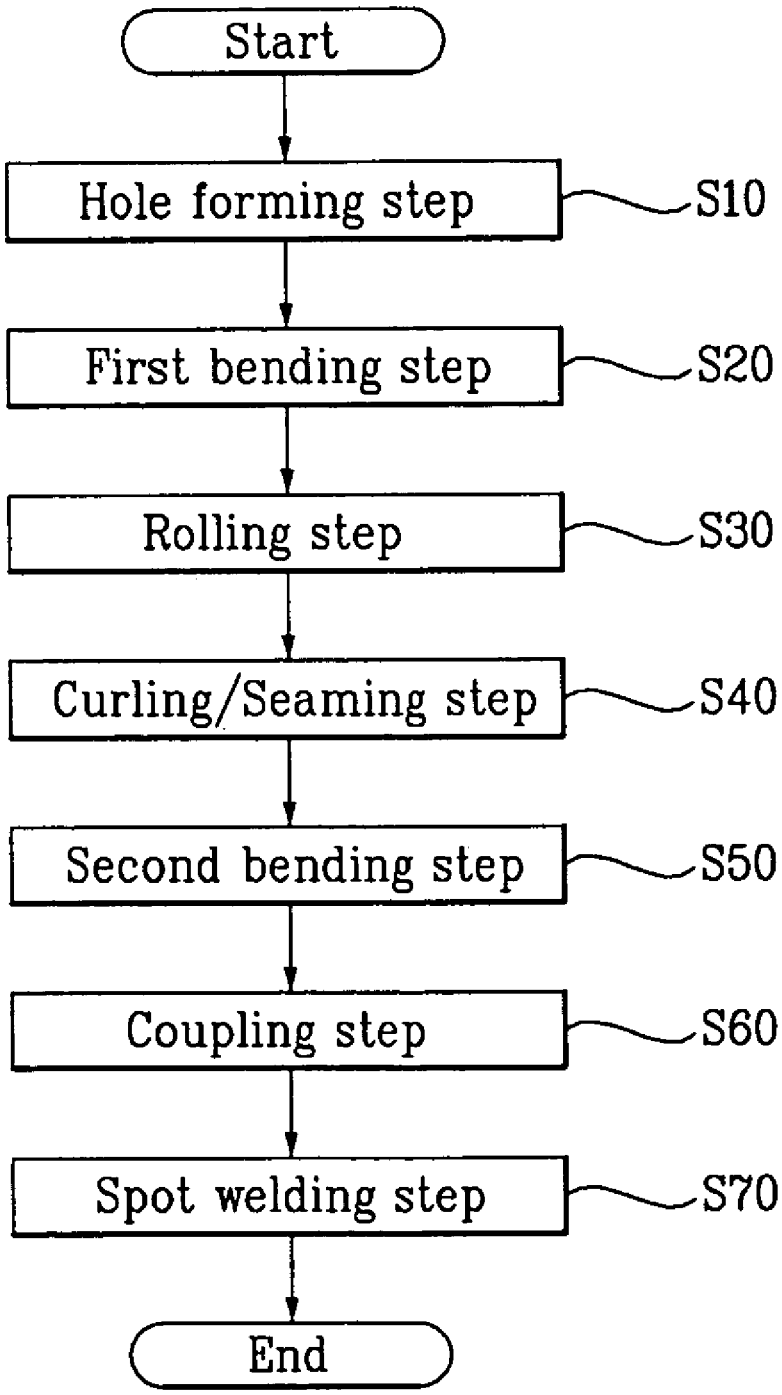
FIG. 2 Prior Art
FIG. 2 is a flow diagram illustrating a method for manufacturing a drum of a washing machine according to the present invention.
Figure 3:
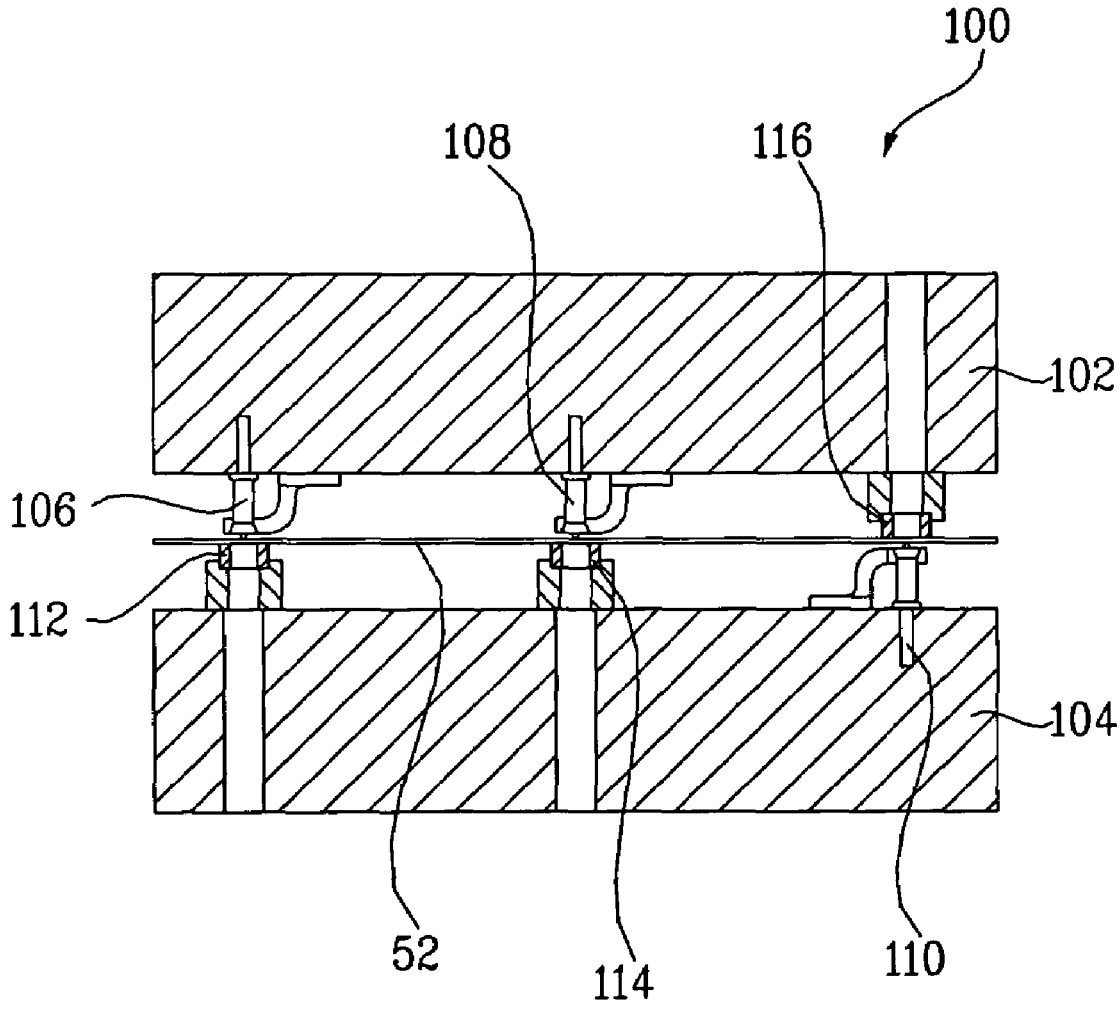
FIG. 3 is a schematic view of a punching unit used for forming a hole in a metal plate in a method for manufacturing a drum of a washing machine according to the present invention.
Figure 4:
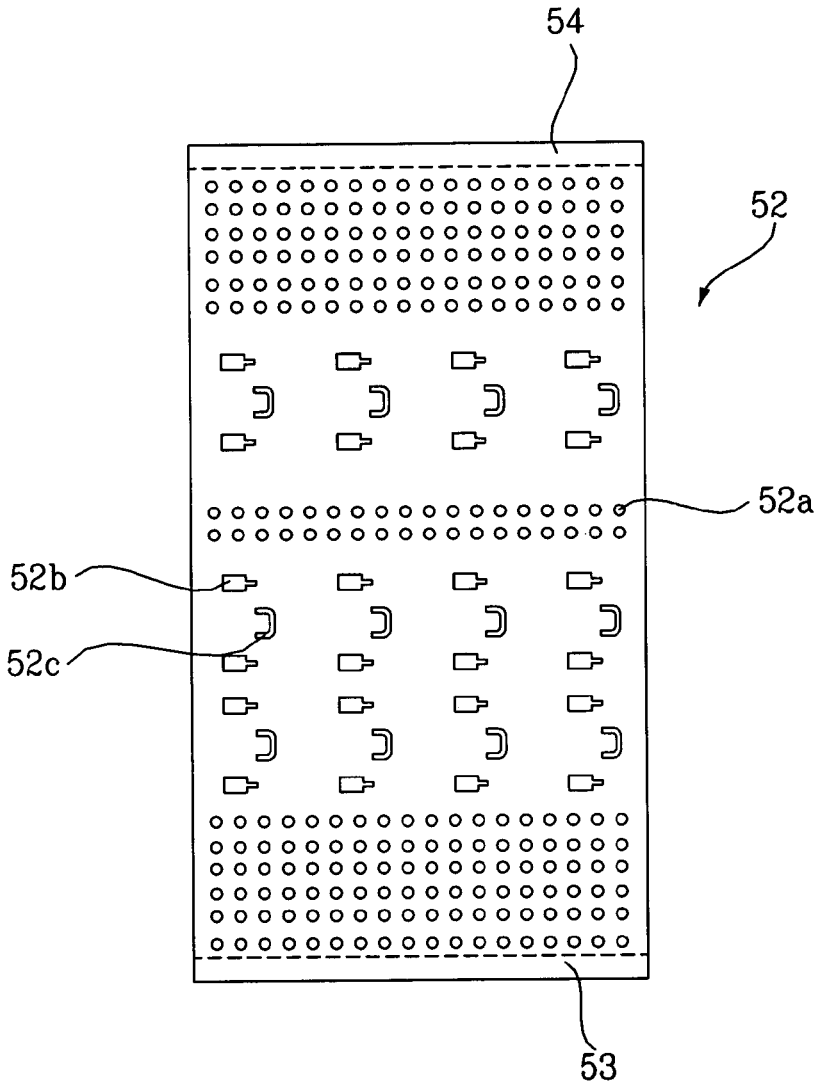
FIG. 4 is a plane view of a metal plate having a hole formed by the punching unit shown in FIG. 3.

FIG. 2 is a flow diagram illustrating a method for manufacturing a drum of a washing machine according to the present invention, FIG. 3 is a schematic view of a punching unit used for forming a hole in a metal plate in a method for manufacturing a drum of a washing machine according to the present invention, and FIG. 4 is a plane view of a metal plate having a hole formed by the punching unit shown in FIG. 3.

In a method for manufacturing a drum of a washing machine according to an embodiment of the present invention, a plurality of holes 52*a*, 52*b* and 52*c* are formed in a rectangular metal plate 52 as shown in FIGS. 2 through 4. (Hereinafter referred to as 'hole forming step (S10))

The hole forming step S10 includes a hole piercing step of piercing a hole 52*a* through which water or air passes, a mounting hole piercing step of piercing mounting holes 52*b* and 52*c* to which a lifter is mounted, and an inverse burring step of removing a bur formed during the hole piercing step.

As shown in FIG. 3, the hole piercing step, the mounting hole piercing step and the inverse burring step are performed by a punching unit 100.

The punching unit 100 includes upper and lower frames 102 and 104 spaced apart from each other by a distance of at least thickness of the metal plate 52, a plurality of punches 106, 108 and 110 installed at the upper and lower frames 102 and 104, and dies 112, 114 and 116.

In the plurality of punches 106, 108 and 110 and dies 112, 114 and 116 provided at the upper and lower frames 102 and 104, the hole piercing punch 106 and the die 112 oppose each other, the mounting hole piercing punch 108 and the die 114 oppose each other, and the inverse burring punch 110 and the die 116 oppose each other.

The inverse burring punch 110 and the die 116 are provided opposite to the hole piercing punch 106 and the die 112. Accordingly, the inverse burring punch 110 punch in an opposite direction to the hole piercing punch 106 to remove the bur generated in the course of the hole piercing step.

If the holes 52*a*, 52*b* and 52*c* are formed as described above, both edges 53 and 54 of the metal plate 52 formed with the holes 52*a*, 52*b* and 52*c* are bent in opposite directions. (Hereinafter referred to as 'first bending step (S20))

Figure 5:
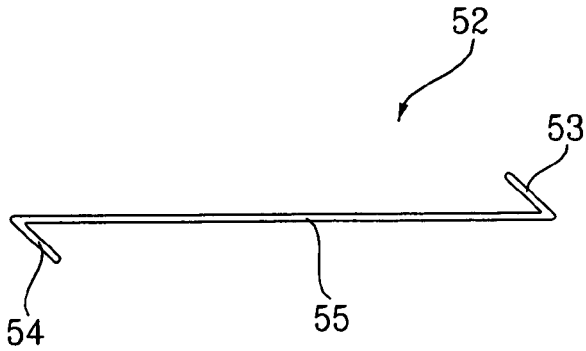
FIG. 5 is a side view of the metal plate shown in FIG. 4 after being bent.

FIG. 5 is a side view of the metal plate shown in FIG. 4 after being bent.

As shown in FIG. 5, in the first bending step S20, both edges of the metal plate 52 formed with the holes are respectively bent more than 90 degrees. It is preferable to bend the metal plate 52 in a shape of letter 'z' such that a rolling step S30 to be described later can be easily performed.

After the above steps are performed, a center portion 55 of the metal plate 52 is rolled in a shape of a hollow cylinder and the bent edge 53 engages with the other bent edge 54. Preferably, the bent edge 53 is latched to the other bent edge 54. (Hereinafter referred to as 'rolling step' (S30))

Figure 6:
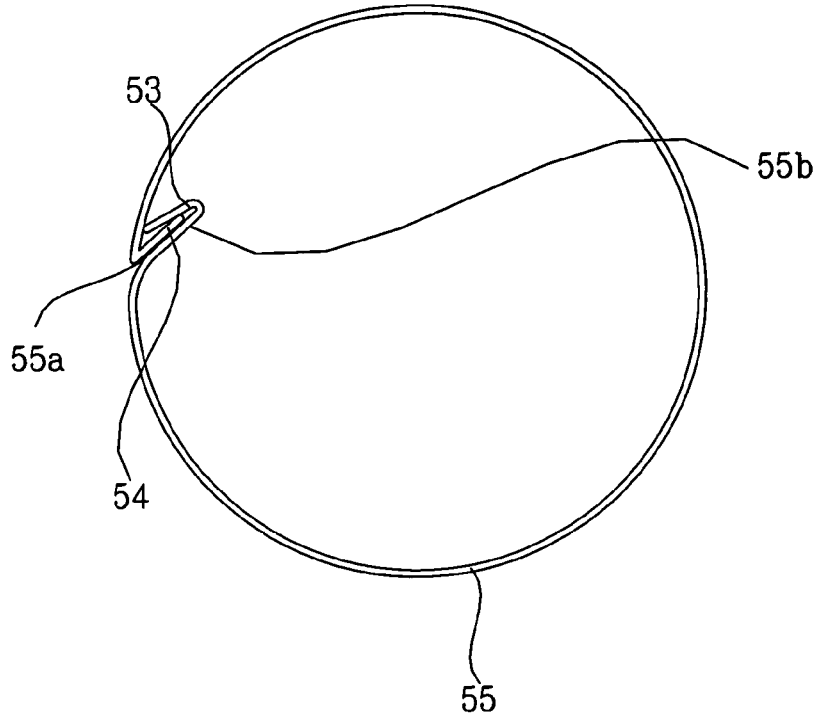
FIG. 6 is a side view of the metal plate shown in FIG. 5 after being rolled.

As shown in FIG. 6, when the center portion 55 of the metal plate 52 is rolled into the shape of a hollow cylinder, a center contact 55*a* is formed at a portion where the bent portions 53 and 54 meet with each other, and a center protrusion 55*b* is formed at a portion of the inner circumferential surface of the hollow cylinder.

The bent edge 53 and the other bent edge 54 are curled against the inner surface of the hollow cylinder 55 and then the bent edge 53 and the other bent edge 54 are seamed with the hollow cylinder 55. (Hereinafter referred to as 'curling/seaming step' (S40)

Figure 7:
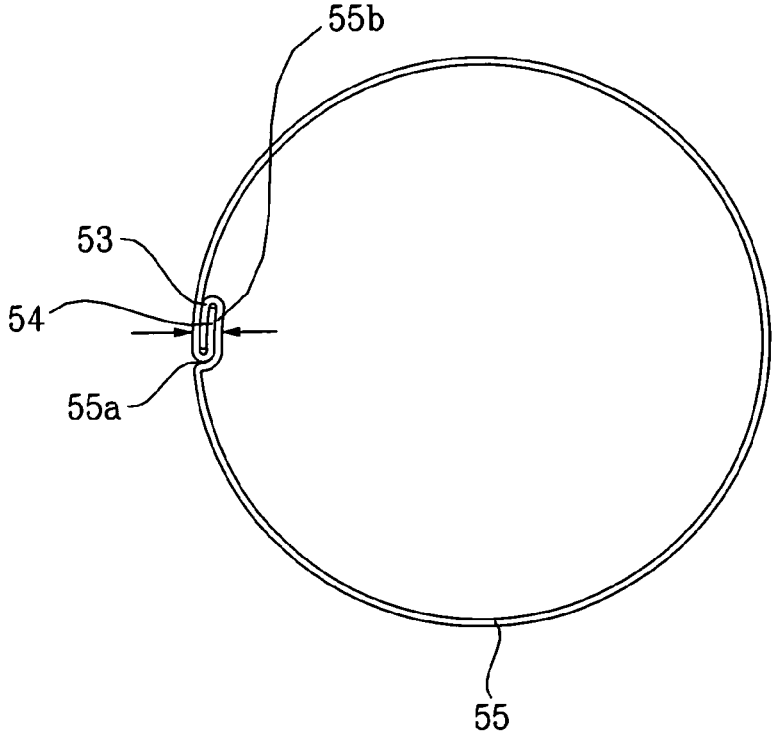
FIG. 7 is a side view illustrating a step of curling one bent portion and the other bent portion shown in FIG. 6.

FIG. 7 is a side view illustrating a step of curling one bent portion and the other bent portion shown in FIG. 6.

As shown in FIG. 7, when the bent edge 53 and the other bent edge 54 are curled against the inner surface of the hollow cylinder 55, the center protrusion 55*b*, the bent edge 53, the other bent edge 54 and the hollow cylinder 55 contact one another, overlapping with one another in a radial direction.

Figure 8:
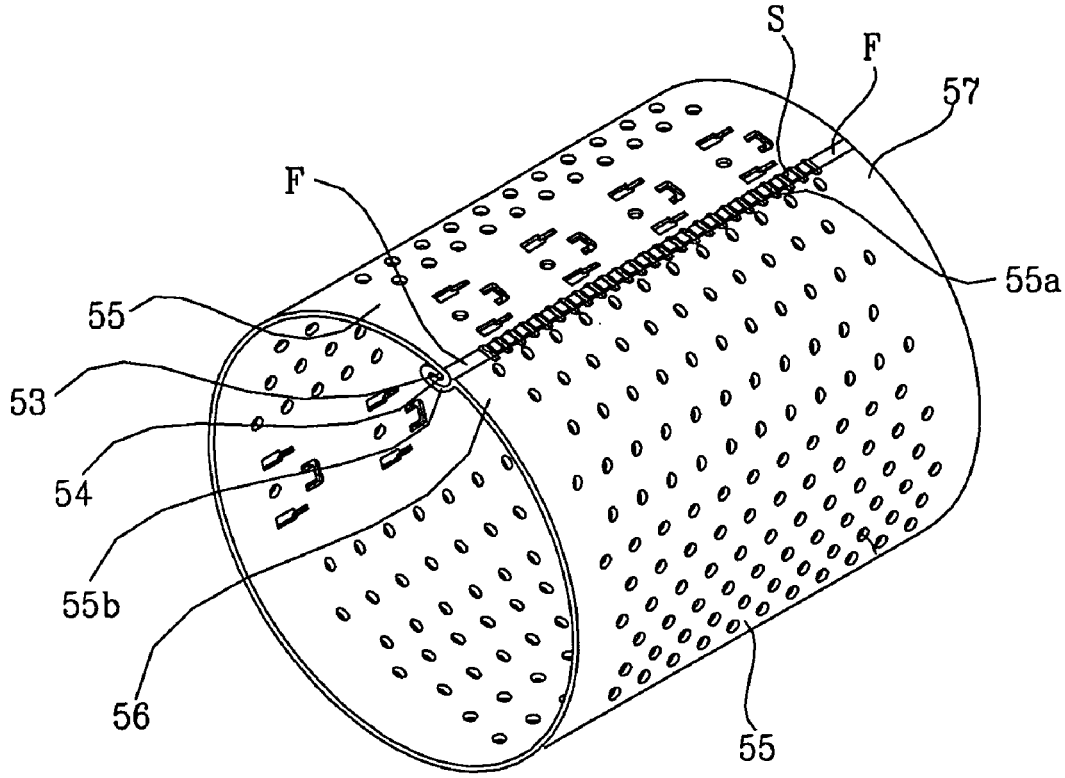
FIG. 8 is a detailed perspective view of the hollow cylinder shown in FIG. 7 after being seamed.
Figure 9:
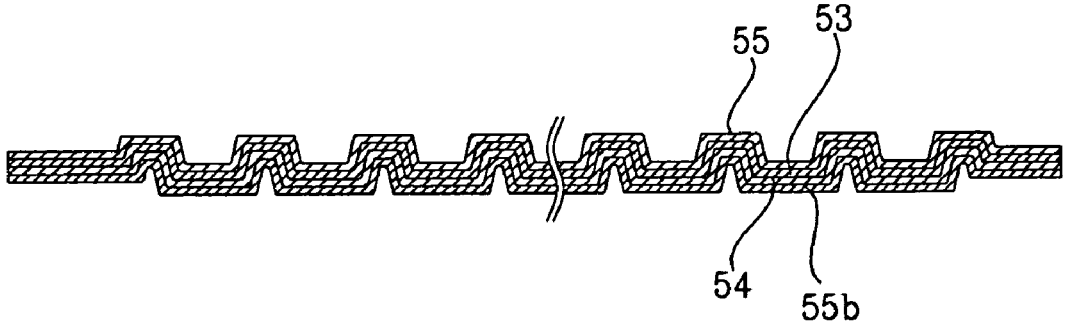
FIG. 9 is a sectional view of the hollow cylinder shown in FIG. 7 after being seamed.

FIG. 8 is a detailed perspective view of the hollow cylinder shown in FIG. 7 after being seamed, and FIG. 9 is a sectional view of the hollow cylinder shown in FIG. 7 after being seamed.

When the bent edges 53 and 54 are seamed, the center protrusion 55*b*, the bent edges 53 and 54, and the hollow cylinder 55 are coupled with one another, forming continuous protrusions and grooves, as shown in FIGS. 8 and 9.

Here, the seaming part 'S' includes the surrounding area of the center contact 55*a*, so that the bent edges are firmly joined at the center contact 55*a*.

In the curling/seaming step S40, the end portions of the hollow cylinder 55 are not seamed but flattened, so that a flattening part 'F' is formed in the end portions of the hollow cylinder 55 on both sides of the seaming part 'S'.

After the bent edges 53 and 54 are curled and seamed with the hollow cylinder 55, the seamed hollow cylinder takes a form of a drum. Hence, the drum is referred to as a center drum 58 as shown in FIG. 10.

Thus, at the end portions of the center drum which have curled/seamed/flattened, a second front bent edge 56 and a second back bent edge 57 are formed. (Hereinafter referred to as 'second bending step' (S50)).

After that, the front drum and the back drum are coupled with the center drum 58. (Hereinafter referred to as 'coupling step' (S60)).

Figure 10:
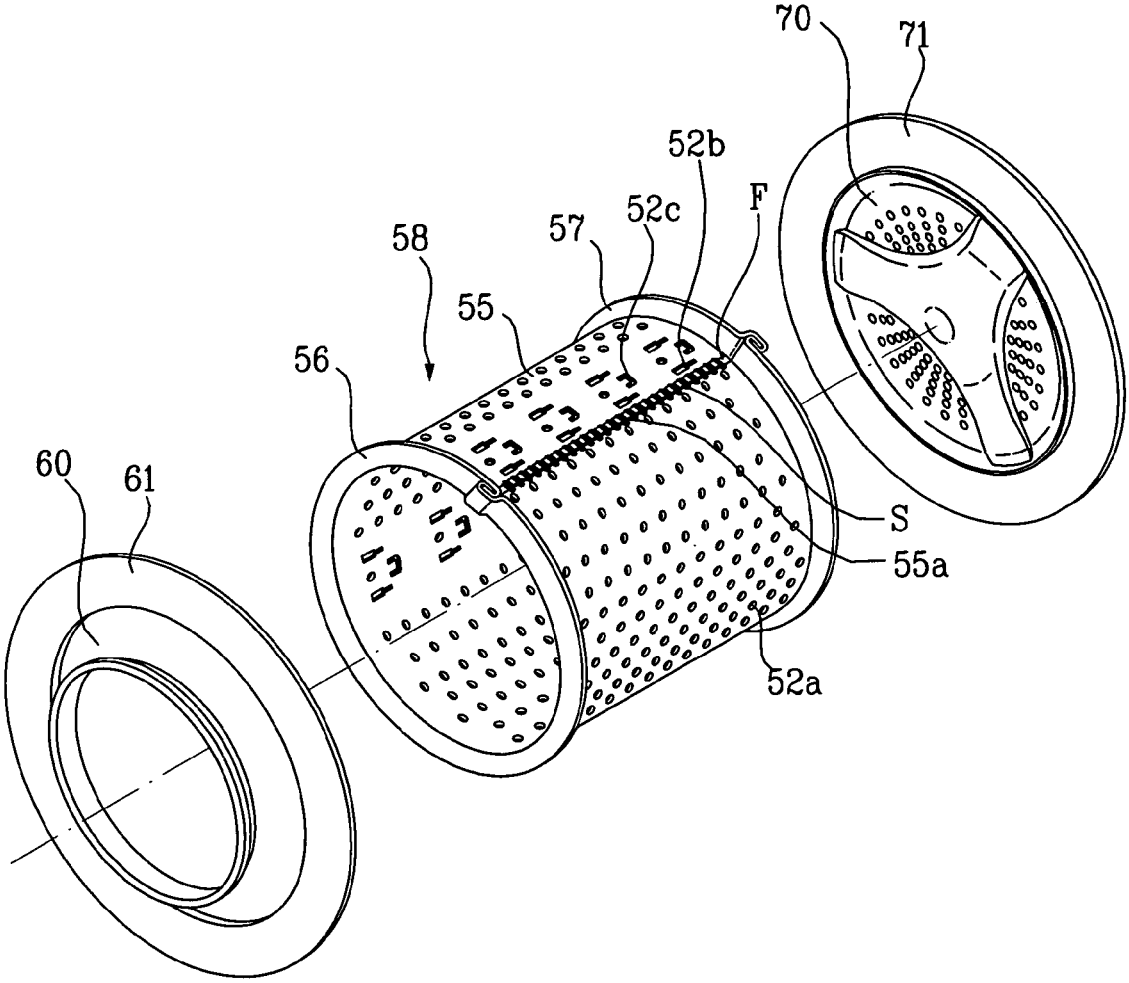
FIG. 10 is a perspective view of a drum of a washing machine before being coupled according to the present invention.
Figure 11:
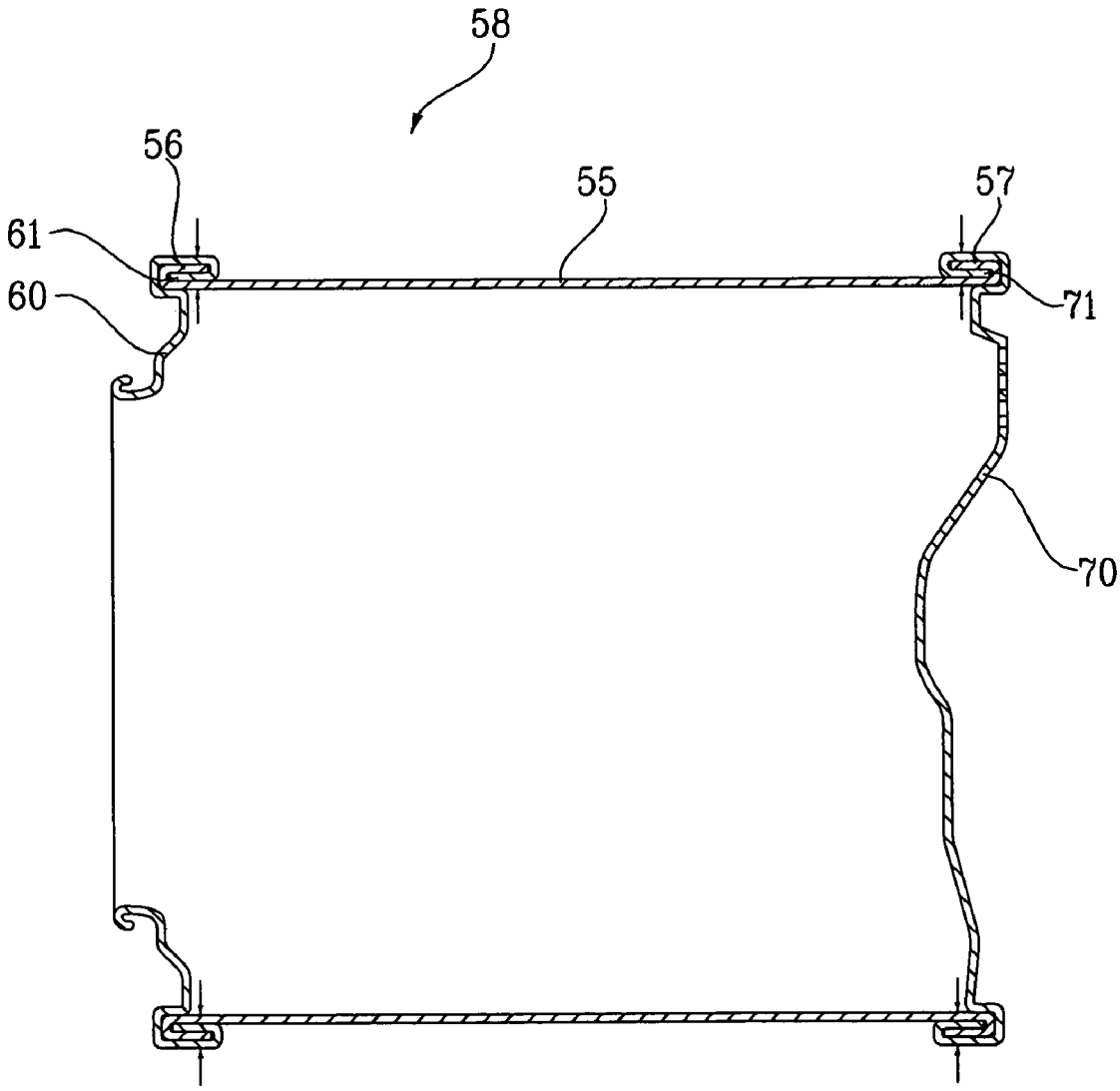
FIG. 11 is a sectional view illustrating that a front drum and a back drum are curled to the center drum shown in FIG. 10.
Figure 12:
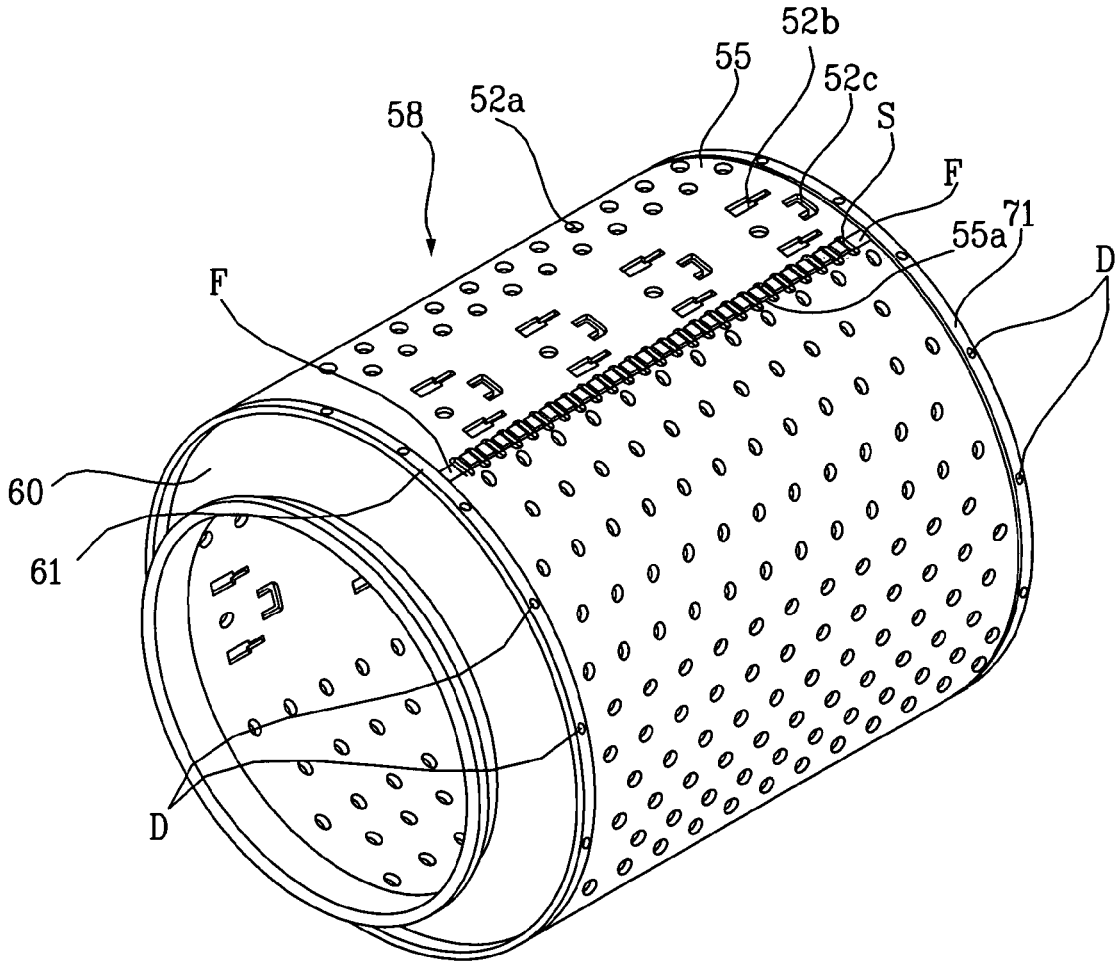
FIG. 12 is a perspective view illustrating that a front drum and back drum are spot-welded to the center drum shown in FIG. 10.

FIG. 10 is a perspective view of a drum of a washing machine before being coupled according to the present invention, FIG. 11 is a sectional view illustrating that a front drum and a back drum are curled to the center drum shown in FIG. 10, and FIG. 12 is a perspective view illustrating that a front drum and back drum are spot-welded to the center drum shown in FIG. 10.

In the coupling step S60, a circumference 61 of the front drum 60 encloses the second front bent edge 56 of the center drum, and the circumference 61 of the front drum 60 and the second front bent edge 56 are curled toward the outer surface of the hollow cylinder 55.

Then, a circumference 71 of the back drum 70 encloses the second back bent edge 57 of the center drum, and the circumference 71 of the back drum 70 and the second back bent edge 57 are curled toward the outer surface of the hollow cylinder 55.

Thereafter, the curled circumference 61 of the front drum 60 and the second front bent edge 56 are spot-welded 'D' to the hollow cylinder 55 and the curled circumference 71 of the back drum 70 and the second back bent edge 57 are spot-welded 'D' to the hollow cylinder 55. (S70)

As described above, according to a method for manufacturing a drum of a washing machine suggested by the present invention, both edges of a metal plate are bent to prepare both bent portions. Both the bent edges are latched with each other and rolled to form a hollow cylinder, and the latched bent portions are curled/seamed with the hollow cylinder, so that the strength of the center drum is enhanced and manufacturing cost is saved.

Also, in the manufacturing method, since a hole through which water or air passes is pierced in a metal plate and a bur generated in the piercing is removed, clothes can be prevented from being damaged due to the bur.

In addition, front and rear edges of the hollow cylinder are bent to form a second front bent edge and a second rear bent edge and the circumference of the front drum and the circumference of the back drum are curled with the second front bent edge and the second back bent edge while enclosing the second front bent edge and the second back bent edge. Accordingly, the center drum can be simply and rigidly coupled with the front drum and the back drum.

Further, since the circumference of the curled front drum and the second front bent edge are spot-welded to the hollow cylinder and the circumference of the curled back drum and the second back bent edge are spot-welded to the hollow cylinder, it is possible to rigidly manufacture the drum at a low cost.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for manufacturing a drum of a washing machine, the method comprising:

forming a plurality of holes on a surface of a metal plate;

bending first and second end portions of the metal plate;

rolling the metal plate into a shape of a hollow cylinder and engaging the first bent end portion with the second bent end portion; and curling the engaged first and second bent end portions toward an inner surface of the hollow cylinder and seaming the engaged first and second bent end portions to an outer surface of the hollow cylinder, forming continuous protrusions and grooves.

2. The method of claim 1, wherein the forming a plurality of holes comprises:

piercing a hole for water or air to pass; and piercing a mounting hole to which a lifter for lifting laundry is mounted.

3. The method of claim 2, wherein the piercing a hole further comprises inverse burring for removing a burr formed in piercing a hole.

4. The method of claim 3, wherein the piercing a hole, the piercing a mounting hole, and the inverse burring are performed by a punching unit.

5. The method of claim 1, wherein the first and second end portions of the metal plate are bent in opposite directions.

6. The method of claim 1, wherein each of the first and second end portions of the metal plate is bent at an angle of more than 90 degrees.

7. The method of claim 1, wherein each of the first and second end portions of the metal plate is bent in a shape of letter "z".

8. A method for manufacturing a drum of a washing machine, the method comprising:

forming a plurality of holes on a surface of a metal plate;

bending first and second end portions of the metal plate;

rolling the metal plate into a shape of a hollow cylinder and engaging the first bent end portion with the second bent end portion;

curling the engaged first and second bent end portions toward an inner surface of the hollow cylinder and seaming the engaged first and second bent end portions to an outer surface of the hollow cylinder; and flattening protrusions on an inner surface of the hollow cylinder at first and second end portions of the hollow cylinder, the protrusions caused by curling the first and second end portions of the metal plate.

9. The method of claim 8, wherein the forming a plurality of holes comprises:

piercing a hole for water or air to pass; and piercing a mounting hole to which a lifter for lifting laundry is mounted.

10. The method of claim 9, wherein the piercing a hole further comprises inverse burring for removing a burr formed in piercing a hole.

11. The method of claim 10, wherein the piercing a hole, the piercing a mounting hole, and the inverse burring are performed by a punching unit.

12. The method of claim 8, wherein the first and second end portions of the metal plate are bent in opposite directions.

13. The method of claim 8, wherein each of the first and second end portions of the metal plate is bent at an angle of more than 90 degrees.

14. The method of claim 8, wherein each of the first and second end portions of the metal plate is bent in a shape of letter "z".

15. A method for manufacturing a drum of a washing machine, the method comprising:

forming a plurality of holes on a surface of a metal plate;

bending first and second end portions of the metal plate;

rolling the metal plate into a shape of a hollow cylinder and engaging the first bent end portion with the second bent end portion;

curling the engaged first and second bent end portions toward an inner surface of the hollow cylinder and seaming the engaged first and second bent end portions to an outer surface of the hollow cylinder; and first and second bent end portions of a center drum bent toward an outer surface of the hollow cylinder.

16. The method of claim 15, further comprising coupling a center drum with a front drum and a back drum, the front drum being coupled to the first bent end portion of the center drum and the back drum being coupled to the second bent end portion of the center drum.

17. The method of claim 16, further comprising:

enclosing a circumferential portion of the front drum to the first bent end portion of the center drum; and curling the circumferential portion of the front drum with the first bent end portion of the center drum.

18. The method of claim 17, further comprising spot-welding the curled circumferential portion of the front drum engaged to the first bent end portion of the center drum to the hollow cylinder.

19. The method of claim 16, further comprising:

enclosing a circumferential portion of the back drum to the second bent end portion of the center drum; and curling the circumferential portion of the back drum with the second bent end portion of the center drum.

20. The method of claim 19, further comprising spot-welding the curled circumferential portion of the back drum engaged to the second bent end portion of the center drum to the hollow cylinder.

* * * * *